US009527079B2

(12) United States Patent
Park et al.

(10) Patent No.: US 9,527,079 B2
(45) Date of Patent: Dec. 27, 2016

(54) FLUID ANALYSIS CARTRIDGE

(71) Applicant: SAMSUNG ELECTRONICS CO., LTD., Suwon-si (KR)

(72) Inventors: Ji Young Park, Seoul (KR); Seung Hoon Kim, Suwon-si (KR); Jung Ki Min, Suwon-si (KR); Seung Jun Lee, Yongin-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 79 days.

(21) Appl. No.: 14/251,045

(22) Filed: Apr. 11, 2014

(65) Prior Publication Data

US 2014/0377133 A1 Dec. 25, 2014

(30) Foreign Application Priority Data

Jun. 19, 2013 (KR) ..... 10-2013-0070386

(51) Int. Cl.
*B01L 3/00* (2006.01)

(52) U.S. Cl.
CPC .... *B01L 3/502753* (2013.01); *B01L 3/502715* (2013.01); *B01L 2200/027* (2013.01); *B01L 2200/10* (2013.01); *B01L 2300/0681* (2013.01); *B01L 2300/0864* (2013.01)

(58) Field of Classification Search
CPC ..... B01L 3/502753; B01L 3/502715; B01L 2300/0864; B01L 2200/10; B01L 2200/027; B01L 2300/0681
See application file for complete search history.

(56) References Cited

U.S. PATENT DOCUMENTS 4,738,823 A * 4/1988 Engelmann ..... G01N 33/525 422/401
5,208,163 A * 5/1993 Charlton ..... B01L 3/502753 422/947
5,389,338 A * 2/1995 Fish ..... 422/401
5,597,532 A * 1/1997 Connolly ..... 422/401

* cited by examiner

*Primary Examiner* — Lore Jarrett
(74) *Attorney, Agent, or Firm* — Sughrue Mion, PLLC

(57) ABSTRACT

Provided is a fluid analysis cartridge that performs a test on a fluid sample. The fluid analysis cartridge includes: a testing part configured to receive a fluid sample and configured to perform a test on the fluid sample; a housing including at least one supply hole configured to supply the fluid sample to the testing part; a filtering part that is disposed between the at least one supply hole and the testing part and is configured to filter a particular material included in the fluid sample; and at least one stepped part provided on a surface of the housing facing the filtering part and that forms a gap between the filtering part and the surface of the housing.

19 Claims, 8 Drawing Sheets

FLUID ANALYSIS CARTRIDGE

CROSS-REFERENCE TO RELATED APPLICATION

This application claims priority from Korean Patent Application No. 10-2013-0070386, filed on Jun. 19, 2013 in the Korean Intellectual Property Office, the disclosure of which is incorporated herein by reference in its entirety.

BACKGROUND

1. Field

Apparatuses and methods consistent with exemplary embodiments relate to a fluid analysis cartridge that analyzes a fluid sample.

2. Description of the Related Art

Apparatuses and methods to analyze a fluid sample are required in various fields, such as environmental monitoring, food inspection, and medical diagnosis. In the related art, in order to perform a test according to a predetermined protocol, a skilled experimenter should manually perform various processes, such as injecting reagent injection several times, mixing fluids to create a mixture, separating and moving, reacting fluids or other components together, and using centrifugation, and this manual work may cause an error in a testing result.

In order to solve the above problems, miniaturized and automated equipment that may quickly analyze a testing material has been developed. In particular, since a portable fluid analysis cartridge can quickly analyze the testing material without being limited to being used in a particular place, more diverse functions can be performed in a diverse range of fields by improving the structure and function of the fluid analysis cartridge. Thus, research and development into the fluid analysis cartridge is being conducted. Also, the fluid analysis cartridge has an advantage that testing can be easily performed by an unskilled person.

In the related art, a filtering part to filter out materials from a fluid to be tested is packed. However, in this case, filtering efficiency of the fluid sample is lowered.

SUMMARY

One or more exemplary embodiments provide a fluid analysis cartridge having an improved structure including a combined housing part and filtering part so that a fluid can be separated from the filtering part.

In accordance with an aspect of an exemplary embodiment, there is provided a fluid analysis cartridge including: a testing part configured to receive a fluid sample and configured to perform a test on the fluid sample; a housing including at least one supply hole configured to supply the fluid sample to the testing part; a filtering part that is disposed between the at least one supply hole and the testing part and that is configured to filter a particular material included in the fluid sample; and at least one stepped part provided on a surface of the housing facing the filtering part and that forms a gap between the filtering part and the surface of the housing.

The at least one stepped part may include a first stepped part provided along a border of the supply hole and configured to accommodate at least a portion of the filtering part and a second stepped part that is stepped with respect to the first stepped part.

The second stepped part may be provided in a radial shape with respect to the supply hole.

The second stepped part may be a groove formed concavely with respect to the first stepped part.

The second stepped part may have a depth of at least 1 μm with respect to the first stepped part or a depth that is less than or equal to 90% of a depth of the first stepped part.

The second stepped part may be a protrusion that protrudes from the first stepped part.

The at least one stepped part may include eight to sixteen second stepped parts which may be provided on the surface of the housing.

The at least one stepped part may include a plurality of second stepped parts, and a gap between adjacent ones of the second stepped parts may be the same length.

The second stepped part may be formed along a circumference of the first stepped part.

The filtering part may include a porous membrane including a plurality of pores configured to filter a material having at least a predetermined size within the fluid sample.

A diameter of each of the plurality of pores of the porous membrane may be 0.1 μm to 500 μm.

In accordance with an aspect of another exemplary embodiment, there is provided a fluid analysis cartridge including a housing including a supply hole configured to receive a fluid sample; a filtering part including an edge portion disposed to protrude inside of the housing, the filtering part being configured to filter the fluid sample; and a first flow path formed between a top surface of the edge portion of the filtering part and a bottom surface of the housing which faces the top surface of the edge portion of the filtering part, wherein the top surface of the edge portion of the filtering part and the bottom surface of the housing are configured to contact the fluid sample flowing through the first flow path.

The first flow path may be provided to have a depth of at least 1 μm or a depth that corresponds to less than or equal to 90% of a depth of the supply hole.

The first flow path may be formed by a stepped part formed close to the supply hole.

The stepped part may be provided in a radial shape with respect to the supply hole.

The stepped part may be provided in a shape corresponding to a border of the supply hole.

The fluid analysis cartridge may further include a testing part that is combined with the housing, the testing part including a second flow path through which the fluid sample filtered by the filtering part is configured to flow.

The testing part may include an upper plate and a lower plate having a film shape and an intermediate plate inserted between the upper plate and the lower plate, and the second flow path may be formed on the intermediate plate.

The intermediate plate may include a plurality of testing chambers in which the fluid sample is configured to be tested.

The filtering part may include a porous membrane including a plurality of pores configured to filter a material having at least a predetermined size within the fluid sample.

BRIEF DESCRIPTION OF THE DRAWINGS

The above and/or other aspects will become apparent and more readily appreciated from the following description of exemplary embodiments, taken in conjunction with the accompanying drawings of which.

DETAILED DESCRIPTION

Figure 1:
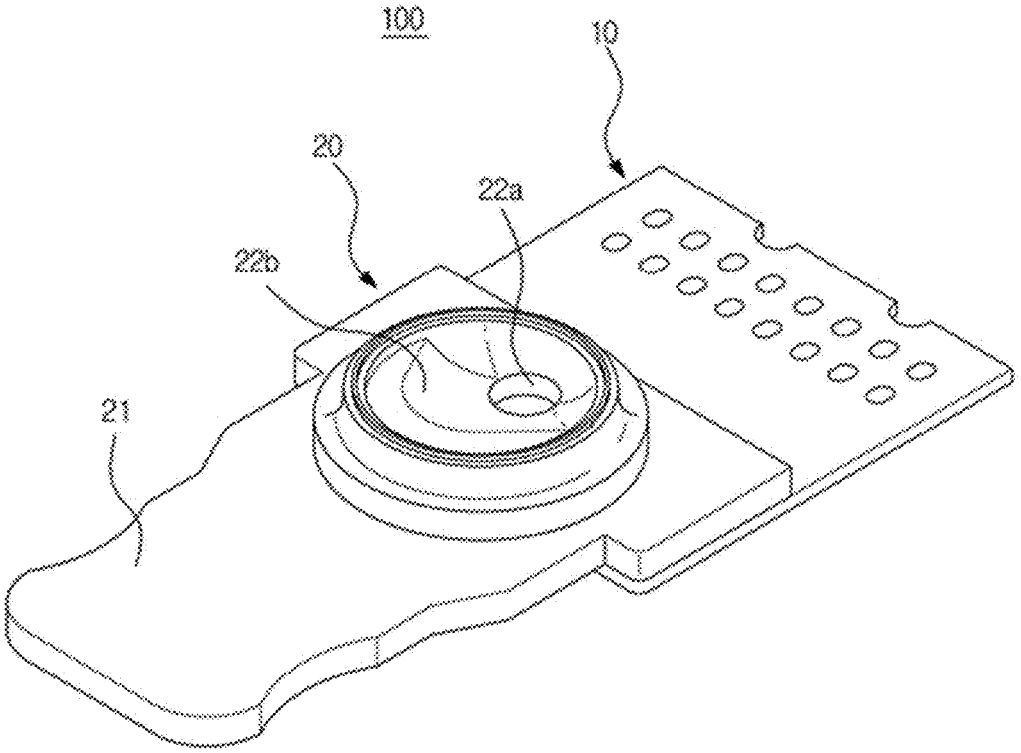
FIG. 1 illustrates a top surface of a fluid analysis cartridge in accordance with an exemplary embodiment.

Reference will now be made in detail to the exemplary embodiments, examples of which are illustrated in the accompanying drawings, wherein like reference numerals refer to like elements throughout.

Figure 2:
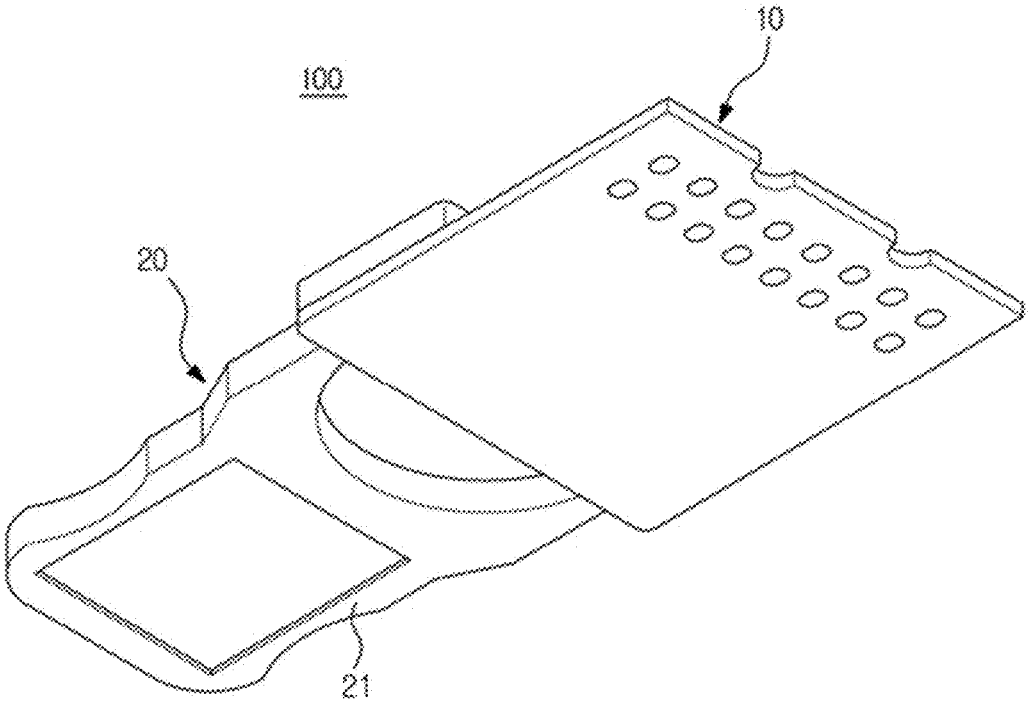
FIG. 2 illustrates a bottom surface of the fluid analysis cartridge illustrated in FIG. 1.

FIG. 1 illustrates a top surface of a fluid analysis cartridge in accordance with an exemplary embodiment, and FIG. 2 illustrates a bottom surface of the fluid analysis cartridge illustrated in FIG. 1.

As illustrated in FIGS. 1 and 2, a fluid analysis cartridge 100 in accordance with an exemplary embodiment includes a housing 20 that constitutes an exterior of the fluid analysis cartridge 100 and a testing part 10 in which a reaction between a fluid and a reagent occurs.

The housing 20 provides a grasping part 21 which supports the fluid analysis cartridge 100 and by which a user grasps the fluid analysis cartridge 100. The fluid analysis cartridge 100 has an advantage that a fluid sample can be quickly tested without being limited to use in a particular place. In particular, in regard to a test of a biological sample extracted from the human body, a test performed by a user, such as a patient, a doctor, a nurse, and a clinical pathologist, at a variety of different places other than a central testing room, such as home, a workplace, a hospital outpatient clinic, a hospital room, an emergency room, an operating room, and an intensive care unit, is referred to as point of care testing (POCT).

The fluid analysis cartridge 100 used in the POCT is frequently transported by the user. Thus, there is a risk that the fluid analysis cartridge 100 will drop during transportation, and if the user does not properly grasp the fluid analysis cartridge 100 during the supplying of the fluid sample, the supplying of the fluid sample cannot be smoothly performed.

Thus, the housing 20 of the fluid analysis cartridge 100 in accordance with the current exemplary embodiment provides the grasping part 21 having a shape in which a user can easily grasp the fluid analysis cartridge 100. In accordance with the current exemplary embodiment, the grasping part 21 is formed in a streamlined protrusion shape, and the user may stably grasp the fluid analysis cartridge 100 without touching the testing part 10 or fluid supply parts 22*a* and 22*b*.

Also, the fluid supply parts 22*a* and 22*b*, to which the fluid sample is supplied, are provided on the housing 20. The fluid sample that may be analyzed in the fluid analysis cartridge 100 in accordance with the current exemplary embodiment may be many different types of biological samples, such as a bodily fluid including blood, a tissue fluid, a lymph fluid, saliva, or urine, or an environmental sample for water quality control or soil management. However, exemplary embodiments are not limited to any particular type of the fluid sample to be analyzed.

The fluid supply parts 22*a* and 22*b* include a supply hole 22*a* through which the supplied fluid sample flows into the testing part 10, and a supply-assisting part 22*b* that assists the supply of the fluid.

As exemplarily shown in FIG. 1, the supply hole 22*a* may be formed in a circular shape. However, exemplary embodiments are not limited thereto, and the supply hole 22*a* may be formed in many other shapes, such as, for example, a polygonal shape. The user may drop the fluid sample to be analyzed into the supply hole 22*a* using a tool, such as a pipette or dropper. However, as the fluid analysis cartridge 100 is miniaturized, the size of the supply hole 22*a* is correspondingly decreased. Thus, as the size of the supply hole 22*a* decreases, it may become more difficult to accurately drop the fluid sample into the supply hole 22*a*.

Thus, the supply-assisting part 22*b* is formed in the vicinity of the supply hole 22*a* to be inclined in a direction of the supply hole 22*a* so that the fluid sample dropped in the vicinity of the supply hole 22*a* may flow into the supply hole 22*a*. In detail, if the user does not accurately drop the fluid sample into the supply hole 22*a* and a part of the fluid sample drops in the vicinity of the supply hole 22*a*, the fluid sample dropped in the vicinity of the supply hole 22*a* flows into the supply hole 22*a* due to the inclination of the supply-assisting part 22*b*.

Also, the supply-assisting part 22*b* may not only assist the supply of the fluid sample but also prevent contamination of the fluid analysis cartridge 100 due to a wrongly-supplied fluid sample. In detail, even if the fluid sample does not accurately flow into the supply hole 22*a*, the supply-assisting part 22*b* in the vicinity of the supply hole 22*a* prevents the fluid sample from flowing into the testing part 10 or the grasping part 21. Thus, contamination of the fluid analysis cartridge 100 caused by the fluid sample can be prevented, and a fluid sample that may be harmful to the human body can be prevented from contacting the user.

As described above, the housing 20 may have a shape for implementing a particular function and may contact the fluid sample. Thus, the housing 20 may be formed of a material that may be easily formed and that is chemically and biologically inactive. For example, the housing 20 may be formed of one of various types of materials including, for example, a plastic material, such as acryl, such as polymethylmethacrylate (PMMA), polysiloxane, such as polydimethylsiloxane (PDMS), polycarbonate (PC), polyethylene, such as linear low density polyethylene (LLDPE), low density polyethylene (LDPE), medium density polyethylene (MDPE), or high density polyethylene (HDPE), polyvinyl alcohol, very low density polyethylene (VLDPE), polypropylene (PP), acrylonitrile butadiene styrene (ABS), and cyclo olefin copolymer (COC), glass, a mica, silica, and a semiconductor wafer. However, the above-described materials are merely examples of materials that may be used as a material of the housing 20, and exemplary embodiments are not limited thereto. Any material having chemical and biological stability and mechanical processability may be used as the material of the housing 20 in accordance with the current exemplary embodiment.

As exemplarily shown in FIG. 1, the fluid supply parts 22*a* and 22*b* may include only one supply hole 22*a*. However, exemplary embodiments are not limited thereto, and a plurality of supply holes may be provided. When the fluid supply parts 22*a* and 22*b* include a plurality of supply holes, a test can be simultaneously performed on a plurality of different fluid samples of one fluid analysis cartridge. According to exemplary embodiments, the plurality of different fluid samples may have the same type but their sources may be different, the plurality of different fluid samples may have different types and sources, or the plurality of different fluid samples may have the same types and sources but may have different states.

For example, when there are two supply holes, a patient's blood may be supplied to one supply hole, and a lymph fluid of the same patient may be supplied to the other supply hole. Alternatively, the patient's blood may be supplied to one supply hole, and another patient's blood may be supplied to the other supply hole.

Figure 3:
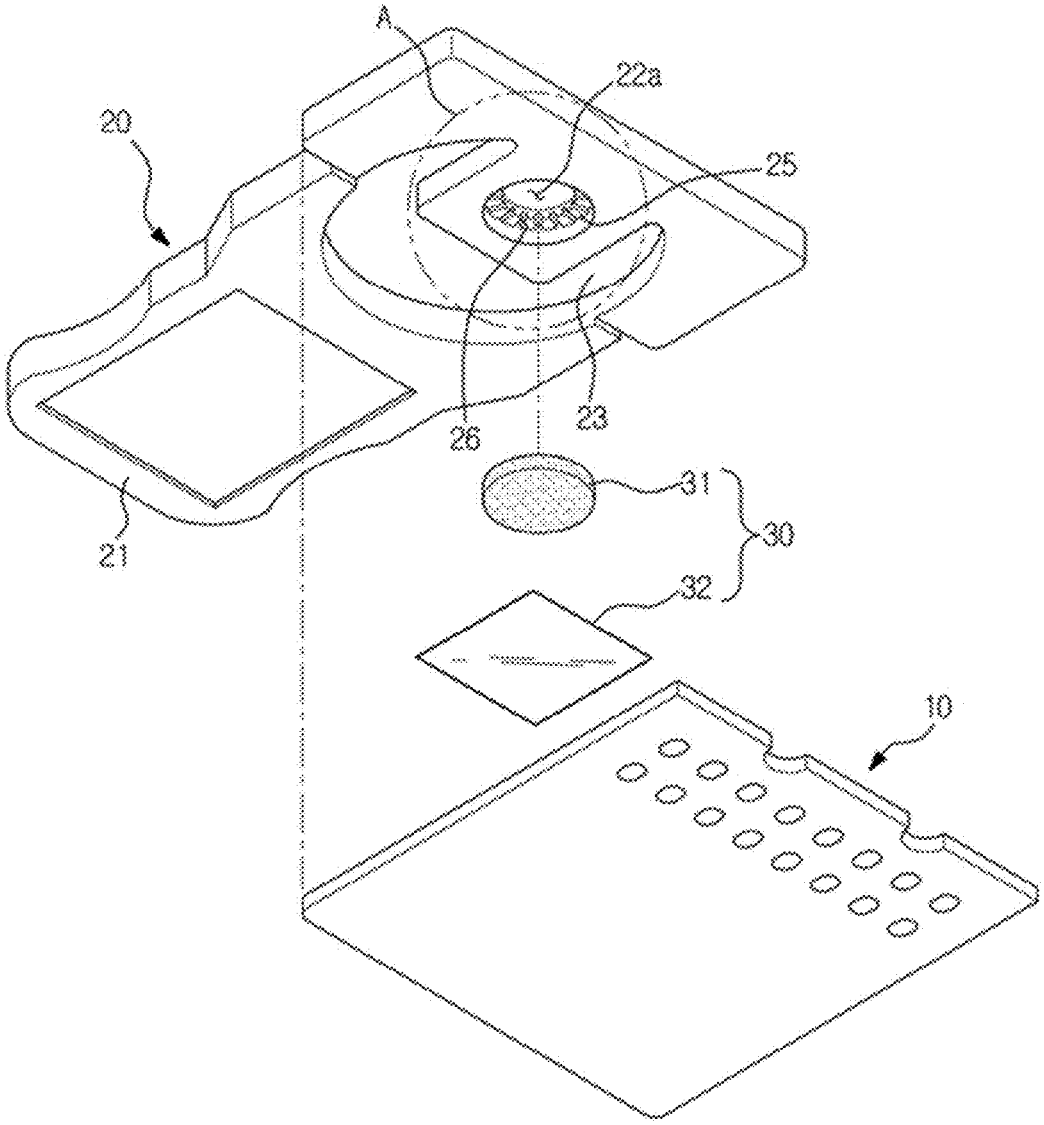
FIG. 3 is an exploded view illustrating the fluid analysis cartridge of FIG. 1.
Figure 4:
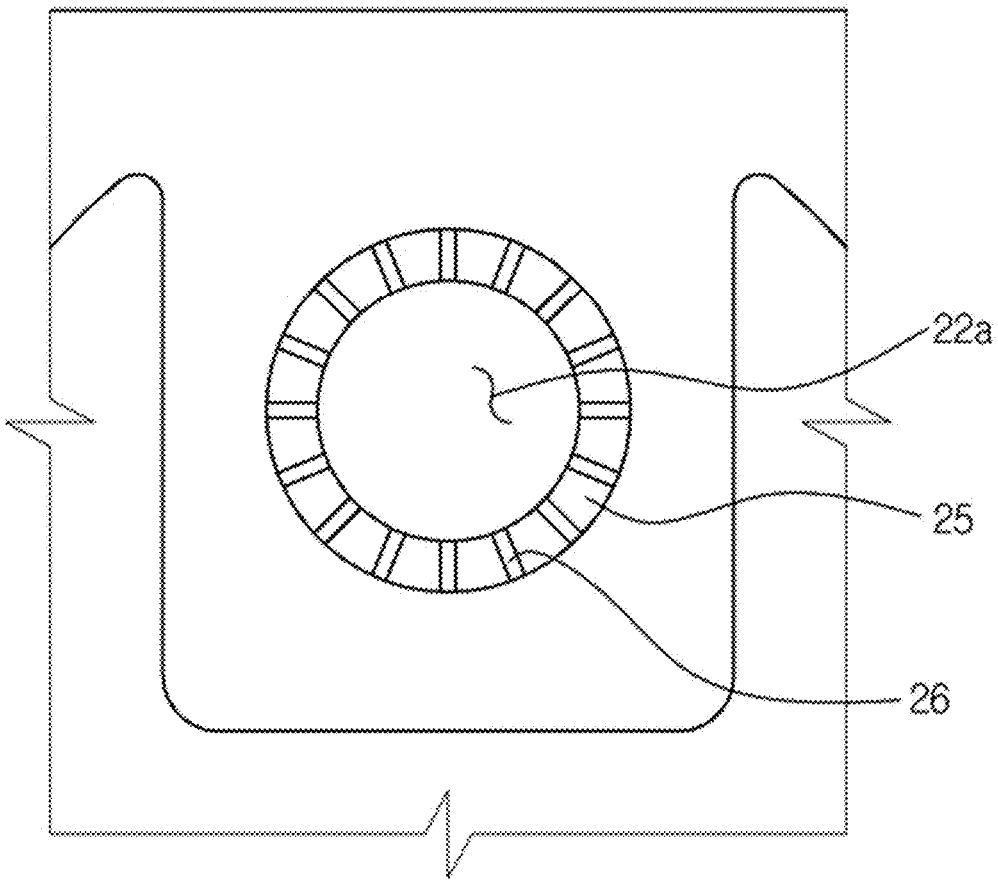
FIG. 4 is an enlarged view of portion A of FIG. 3.

FIG. 3 is an exploded view illustrating the fluid analysis cartridge of FIG. 1, and FIG. 4 is an enlarged view of portion A of FIG. 3.

As illustrated in FIGS. 3 and 4, a filtering part 30 is disposed between the housing 20 and the testing part 10. In accordance with an exemplary embodiment, the filtering part 30 may be disposed as a double layer of a first filtering part 31 and a second filtering part 32. As exemplarily shown in FIG. 3, the first filtering part 31 may be formed in a circular shape. However, exemplary embodiments are not limited thereto, and the first filtering part 31 may be disposed in many other shapes as well, for example, a polygonal shape. The second filtering part 32 is also shown as being formed in a rectangular shape; however, exemplary embodiments are not limited thereto.

Also, a rib 23 may be disposed in the vicinity of the supply hole 22*a* of the housing 20. The rib 23 is provided to reinforce rigidity of the housing 20. In particular, in accordance with an exemplary embodiment, the rib 23 is provided concavely with respect to the surface of the housing 20. This configuration is to prevent the fluid from leaking and to prevent a fluid leakage from affecting an analysis device (not shown) on which the fluid analysis cartridge 100 is mounted.

The fluid sample that flows through the supply hole 22*a* passes through the filtering part 30 and flows into the testing part 10. The filtering part 30 may include at least one or more porous membranes including a plurality of pores so that a material having a predetermined size within at least the fluid sample can be filtered by the filtering part 30. In accordance with the current exemplary embodiment, the filtering part 30 may include the first filtering part 31 and the second filtering part 32. For example, the first filtering part 31 may include a glass fiber, a non-woven fabric, or an absorbent filter. The diameter of a pore of the first filtering part 31 may be 2 to 500 μm, although is not limited thereto. The second filtering part 32 may be formed of polycarbonate (PC), polyethersulfone (PES), polyethylene (PE), polysulfone (PS), polyarylsulfone (PASF), or the like. The diameter of a pore of the second filtering part 32 may be 0.1 to 0.8 μm, although is not limited thereto. The porosity ratio of the filtering part 30 may be 1:1 to 1:200. According to an exemplary embodiment, the porosity ratio refers to the ratio of the sizes of pores formed in the filtering part 30, and in more detail, may represent the ratio of the size of the largest pore with respect to the size of the smallest pore. As the porosity ratio increases, filtering speed increases.

Since the filtering part 30 is formed as the double layer, the second filtering part 32 may perform filtering on the fluid sample that passes through the first filtering part 31 once more. Also, when a large amount of particles having larger sizes than the size of the pores of the filtering part 30 flow into the filtering part 30 simultaneously, the filtering part 30 can be prevented from being torn or damaged. However, exemplary embodiments are not limited thereto, and the filtering part 30 may be provided to include a triple layer or more layers. In this case, a filtering function of the fluid sample is more reinforced, and stability of the filtering part 30 is also improved. Each filtering part 30 may be formed by an adhesive material (not shown), such as a double-sided adhesive.

A coating layer formed of a functional material having a particular function may be formed on the surface of each filtering part 30. In this case, a particular material in the fluid sample may be combined with or adsorbed onto the functional material when the fluid sample passes through the filtering part 30. In this case, the particular material does not pass through the filtering part 30. Thus, the particular material that exists in the fluid sample may be filtered. Also, the functional material may be filled between the filtering parts 30.

The filtering part 30 is inserted into the supply hole 22*a* of the housing 20. In accordance with the current exemplary embodiment, the first filtering part 31 may be inserted into the supply hole 22*a* of the housing 20. Thus, the filtering part 30 may be disposed between the supply hole 22*a* of the housing 20 and the testing part 10. At least one or more stepped parts 25 and 26 may be disposed at one surface of the housing 20 that contacts the filtering part 30. Due to the stepped parts 25 and 26, a gap between the filtering part 30 and the housing 20 may be formed, and this configuration will be described below.

The stepped parts 25 and 26 may include a first stepped part 25 and a second stepped part 26. The first stepped part 25 may be disposed concavely along a border of the supply hole 22*a*. Thus, at least a part of the filtering part 30 may be accommodated in the first stepped part 25. In accordance with the current exemplary embodiment, the first filtering part 31 may be accommodated in the first stepped part 25, and the second filtering part 32 may be connected to the first filtering part 31.

The second stepped part 26 may be disposed to be stepped with respect to the first stepped part 25. In accordance with the current exemplary embodiment, the second stepped part 26 may be disposed in a radial shape with respect to the center of the supply hole 22*a*. The second stepped part 26 may be provided as a groove formed concavely with respect to the first stepped part 25. For example, the second stepped part 26 may have a depth of 1 μm or more with respect to the first stepped part 25. Also, the second stepped part 26 may have a depth that corresponds to 90% or less of the depth of the first stepped part 25. As exemplarily shown in FIG. 4, sixteen second stepped parts 26 are provided. However, exemplary embodiments are not limited thereto, and many different numbers of second stepped parts 26, such as, for example, eight to sixteen second stepped parts 26, may be provided. As exemplarily shown in FIG. 4, each of the second stepped parts 26 may be provided to be spaced apart from each other by a gap having the same length. However, exemplary embodiments are not limited thereto, and gaps between the second stepped parts 26 may have different lengths from each other.

The stepped parts 25 and 26 disposed on the housing 20 may serve as a flow path on which the fluid sample flows, and this flow path may be defined as a first flow path. The first flow path will be described below.

Figure 5:
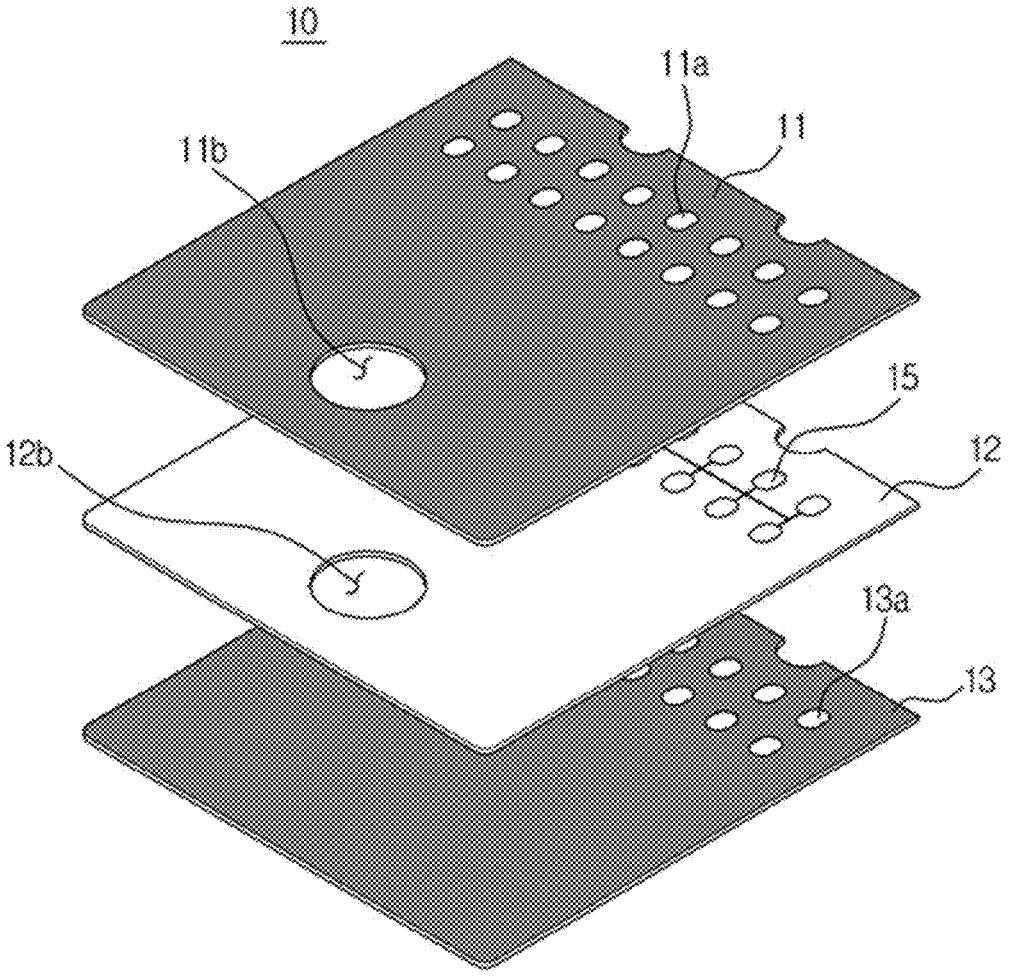
FIG. 5 is an exploded view of a testing part of the fluid analysis cartridge of FIG. 1.

FIG. 5 is an exploded view of a testing part of the fluid analysis cartridge of FIG. 1.

As illustrated in FIG. 5, the testing part 10 of the fluid analysis cartridge 100 of FIG. 1 may be formed to have a structure in which three plates 11, 12, and 13 are connected to each other. The three plates 11, 12, and 13 may be classified into an upper plate 11, a lower plate 13, and an intermediate plate 12. The upper plate 11 and the lower plate 13 may each have a shielding ink printed thereon which may protect the fluid sample from external light as the fluid sample moves to a testing chamber 15 and may prevent an error from occurring when optical characteristics of the testing chamber 15 are measured.

Each of the upper plate 11, the lower plate 13, and the intermediate plate 12 may have a thickness of 10 to 300 μm, and the upper plate 11 and the lower plate 13 may be formed as a film.

The film used to form the upper plate 11 and the lower plate 13 of the testing part 10 may be selected from among polyethylene films, such as a VLDPE film, an LLDPE film, an LDPE film, an MDPE film, and an HDPE film, a PP film, a polyvinyl chloride (PVC) film, a polyvinyl alcohol (PVA) film, a polystyrene (PS) film, and a polyethylene terephthalate (PET) film. However, these are merely exemplary materials, and any film formed of a material that is chemically and biologically inactive and has mechanical processability may be used as the film used to form the upper plate 11 and the lower plate 13 of the testing part 10.

The intermediate plate 12 of the testing part 10 is formed as a porous sheet, such as cellulose, unlike in the upper plate 11 and the lower plate 13. Thus, the intermediate plate 12 serves as a vent and causes the fluid sample to be moved within the testing part 10 without an additional driving source.

The testing part 10 may further include an inlet 14 through which the fluid sample passing through the filtering part 30 flows into the testing part 10, a second flow path 14*a* through which the fluid sample flows, and the testing chamber 15 in which a reaction between the fluid sample and the reagent occurs.

An inlet 11*b* through which the fluid sample flows into the testing part 10 may be formed in the upper plate 11, and a region 11*a* of the upper plate 11 that corresponds to the testing chamber 15 may be transparently processed. A region 13*a* of the lower plate 13 that corresponds to the testing chamber 15 may be transparently processed, so as to measure a degree of optical absorbance of the reaction that occurs in the testing chamber 15, e.g., optical characteristics.

An inlet 12*b* through which the fluid sample flows into the testing part 10 is also formed in the intermediate plate 12, and the inlet 11*b* of the upper plate 11 and the inlet 12*b* of the intermediate plate 12 overlap each other to thereby form the inlet 14 of the testing part 10. Various reactions for fluid analysis may occur in the testing chamber 15. When blood is used as the fluid sample, a reagent that reacts with a particular ingredient of blood (in particular, blood plasma) and forms color or causes discoloration, may be accommodated in the testing chamber 15 so that the color expressed in the testing chamber 15 can be optically detected and can be represented as a numerical value. The presence or the rate of occurrence of the particular ingredient within the blood may be checked through the numerical value.

Figure 6:
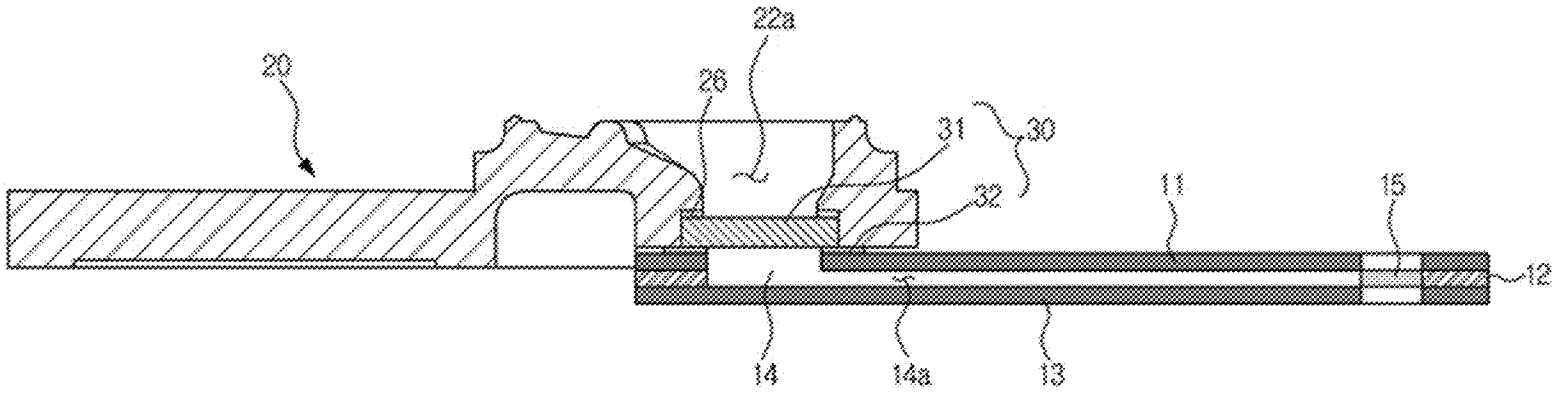
FIG. 6 is a cross-sectional view illustrating a cross-section of the fluid analysis cartridge of FIG. 1.

FIG. 6 is a cross-sectional view illustrating a cross-section of the fluid analysis cartridge of FIG. 1.

As illustrated in FIG. 6, the fluid analysis cartridge 100 may be formed in such a way that the testing part 10 is connected to a lower part of the housing 20. In more detail, the testing part 10 may be connected to lower sides of the fluid supply parts 22*a* and 22*b* in which the supply hole 22*a* is formed. A pressure sensitive adhesive (PSA) may be used to connect the housing 20 and the testing part 10. Thus, the PSA has characteristics that an object to be adhered to another object via the PSA can be adhered to the other object with a small amount of pressure, such as hand pressure, at room temperature within a short time, cohesive failure does not occur during delamination, and no afterimage is left on the surface of the object to be adhered.

However, the housing 20 and the testing part 10 according to the exemplary embodiments are not limited to being connected to each other using the PSA and may alternatively be connected to each other using double-sided adhesives other than, or in addition to, the PSA or in such a way that protrusions may be inserted into grooves.

A groove formed by the second stepped part 26 may be formed between the housing 20 and the filtering part 30 and serves as a first flow path. The fluid sample that flows into the testing part 10 through the supply hole 22*a* may contact the filtering part 30 exposed by the supply hole 22*a*, may be filtered, and then may flow into the inlet 14 of the testing part 10. As shown in FIG. 6, the filtering part 30 may have edge portions disposed to protrude inside of the housing 20. In addition, the fluid sample may pass through the supply hole 22*a* and the first flow path between the housing 20 and the filtering part 30, and may contact a bottom surface of the housing 20, the bottom surface facing a top surface of the respective edge portions of the filtering part 30, may be filtered, and then may flow into the inlet 14 of the testing part 10. The fluid that flows into the inlet 14 of the testing part 10 passes through the second flow path 14*a* formed on the intermediate plate 12, is accommodated in the testing chamber 15, and is tested in the testing chamber 15.

In this way, in accordance with the current exemplary embodiment, the fluid sample may be filtered using the entire area of the filtering part 30.

A fluid analysis cartridge according to the related art has a structure in which a filtering part is pressed in a housing so that the filtering part and the housing can be sealed. In this case, pressure is applied to the filtering part, and thus, it is difficult for the fluid to flow into a testing part. Thus, the fluid is concentrated in a region in which the housing and the filtering part do not contact each other, i.e., the filtering part exposed by a supply hole. As a result, the fluid which is concentrated in a predetermined space disturbs the overall flow of the fluid by closing a pore or pores of the filtering part, and the entire area of the filtering part cannot be used. For example, when a filtering part having a diameter of 7.5 mm is used, theoretically, a filtering part of 44.2 $mm^3$ can be used. However, since the fluid is concentrated only in a region (diameter of 5.5 mm) in which the filtering part and the housing do not contact each other, in actuality, a filtering part of 23.74 $mm^3$ is used. Thus, usage efficiency of the filtering part decreases by 46.2%.

However, in accordance with exemplary embodiments, since the first flow path is formed between the housing 20 and the filtering part 30 due to the second stepped part 26, the fluid may flow into the testing part 10 through the first flow path so that filtering of the fluid can be performed using the entire filtering part 30.

Table 1 shows data obtained by measuring the amount of separated blood plasma in each of an exemplary embodiment in which the second stepped part 26 is used and a comparative example in which no second stepped part 26 is used. The maximum amount of finally-separated blood plasma that can be obtained from the following data is 15 μl.

TABLE 1

| Separated blood plasma (μl) | | |
|---|---|---|
| Sample | Comparative example | Exemplary Embodiment |
| 1 | 15 | 15 |
| 2 | 15 | 15 |

TABLE 1-continued

| Separated blood plasma (μl) | | |
|---|---|---|
| Sample | Comparative example | Exemplary Embodiment |
| 3 | 11.4 | 15 |
| 4 | 11.8 | 15 |
| 5 | 15 | 15 |
| 6 | 11.4 | 15 |
| 7 | 12.2 | 15 |
| 8 | 11.8 | 15 |
| 9 | 13 | 15 |
| 10 | 11.8 | 15 |
| Average | 12.8 | 15 |

As shown in Table 1, by using an exemplary embodiment, a larger average amount of separated blood plasma may be obtained, as compared to an average amount of separated blood plasma obtained by using the comparative example. That is, since the entire area of the filtering part 30 is used, filtering efficiency increases.

Figure 7:
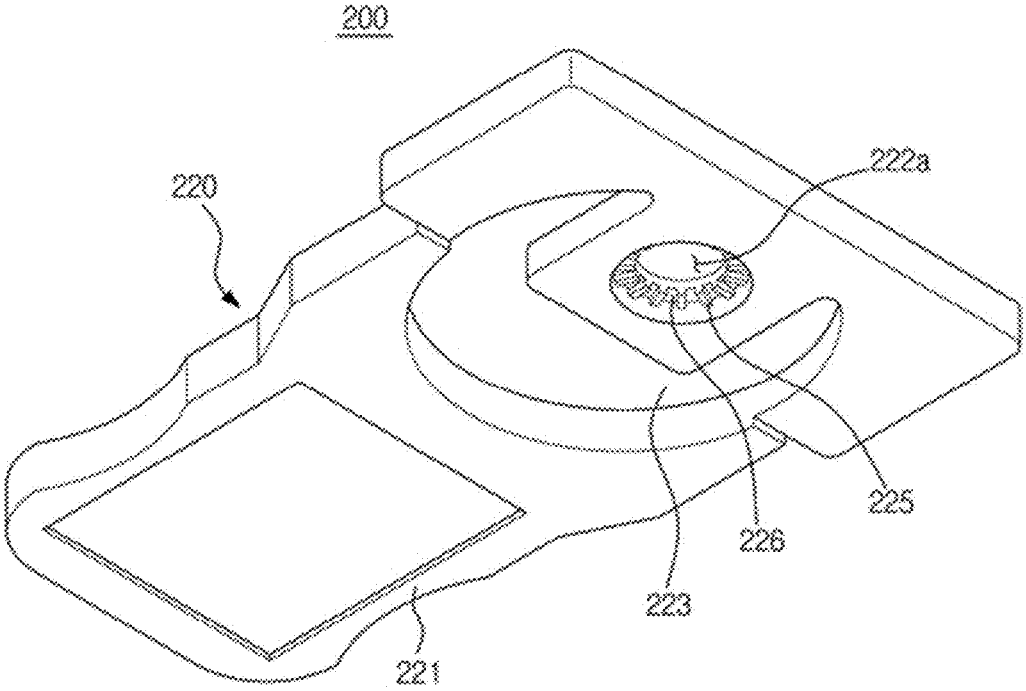
FIG. 7 illustrates a housing of a fluid analysis cartridge in accordance with another exemplary embodiment.

FIG. 7 illustrates a housing of a fluid analysis cartridge in accordance with another exemplary embodiment.

As illustrated in FIG. 7, in accordance with an exemplary embodiment, a housing 220 of a fluid analysis cartridge 200 may include a grasping part 221 and fluid supply parts 222*a* and 223. One of the fluid supply parts 222*a* may be a supply hole 222*a*, and another of the fluid supply parts 223 may be a rib 223 formed in the vicinity of the supply hole 222*a*.

At least one or more stepped parts 225 and 226 may be provided in the vicinity of the supply hole 222*a*. A first stepped part 226 may be concavely provided along a border of the supply hole 222*a*. A second stepped part 225 may be formed in a radial shape with respect to the supply hole 222*a*. In accordance with an exemplary embodiment, the second stepped part 225 may be a protrusion that upwardly protrudes from the first stepped part 226. Thus, a first flow path may be provided between the housing 220 and a filtering part (not shown) by a space formed between the second stepped part 225 and the second stepped part 225. As a result, filtering efficiency of the filtering part (not shown) can be improved.

Figure 8:
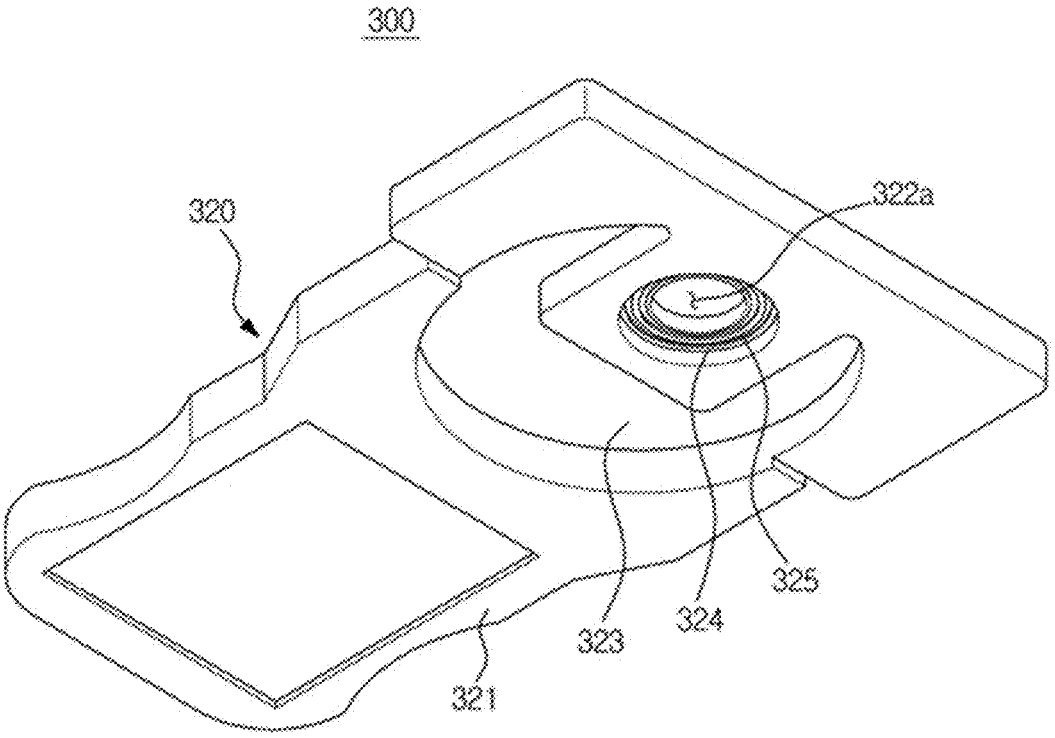
FIG. 8 illustrates a housing of a fluid analysis cartridge in accordance with still another exemplary embodiment.

FIG. 8 illustrates a housing of a fluid analysis cartridge in accordance with still another exemplary embodiment.

As illustrated in FIG. 8, a fluid analysis cartridge 300 in accordance with still another exemplary embodiment includes a housing 320 including a grasping part 321 and a supply hole 322*a*. A rib 323 may be formed in the vicinity of the supply hole 322*a*. At least one or more stepped parts 324 and 325 may be formed along a border of the supply hole 322*a*. A first stepped part 324 may be formed concavely with respect to the surface of the housing 320, and a second stepped part 325 may be formed concavely with respect to the first stepped part 324. The second stepped part 325 may be provided in a shape corresponding to the first stepped part 324. A filtering part (not shown) may be accommodated in the first stepped part 324, and a first flow path may be formed between the second stepped part 325 and a filtering part (not shown) so that a fluid can be filtered using the entire area of the filtering part (not shown).

As described above, in a fluid analysis cartridge in accordance with one or more exemplary embodiments, separation efficiency of a fluid sample with respect to a filtering part can be improved.

Although a few exemplary embodiments have been shown and described, it would be appreciated by those skilled in the art that changes may be made in these exemplary embodiments without departing from the principles and spirit of the disclosure, the scope of which is defined in the claims and their equivalents.

What is claimed is:

1. A fluid analysis cartridge comprising:

a testing part configured to receive a fluid sample and perform a test on the fluid sample;

a housing comprising at least one supply hole configured to supply the fluid sample to the testing part;

a filtering part that is disposed between the at least one supply hole and the testing part and is configured to filter a particular material included in the fluid sample;

at least one stepped part provided on a surface of the housing facing the filtering part and that forms a gap between the filtering part and the surface of the housing; and a first flow path that is formed between a top surface of the filtering part and a bottom surface of the housing facing an edge portion of the top surface of the filtering part, the first flow path being configured to pass the fluid sample before the fluid sample contacts the filtering part, wherein the at least one stepped part comprises a first stepped part provided along a border of the at least one supply hole and configured to accommodate at least a portion of the filtering part and a second stepped part that is stepped with respect to the first stepped part, and wherein the first flow path is formed by the second stepped part.

2. The fluid analysis cartridge of claim 1, wherein the second stepped part is provided in a radial shape with respect to the at least one supply hole.

3. The fluid analysis cartridge of claim 2, wherein the second stepped part is a groove formed concavely with respect to the first stepped part.

4. The fluid analysis cartridge of claim 3, wherein the second stepped part has a depth of at least 1 μm with respect to the first stepped part or a depth that is less than or equal to 90% of a depth of the first stepped part.

5. The fluid analysis cartridge of claim 2, wherein the second stepped part is a protrusion that protrudes from the first stepped part.

6. The fluid analysis cartridge of claim 2, wherein the at least one stepped part comprises eight to sixteen second stepped parts provided on the surface of the housing.

7. The fluid analysis cartridge of claim 2, wherein the at least one stepped part comprises a plurality of second stepped parts, and a gap between adjacent ones of the second stepped parts is the same length.

8. The fluid analysis cartridge of claim 1, wherein the second stepped part is formed along a circumference of the first stepped part.

9. The fluid analysis cartridge of claim 1, wherein the filtering part comprises a porous membrane including a plurality of pores configured to filter a material.

10. The fluid analysis cartridge of claim 9, wherein a diameter of each of the plurality of pores of the porous membrane is 0.1 μm to 500 μm.

11. A fluid analysis cartridge comprising:

a housing comprising a supply hole configured to receive a fluid sample;

a filtering part disposed to protrude inside of the housing, the filtering part being configured to filter the fluid sample;

a first flow path formed between a top surface of an edge of the filtering part and a bottom surface of the housing which faces the top surface of the edge of the filtering part, the first flow path being configured to pass the fluid sample before the fluid sample contacts the edge of the filtering part; and a stepped part comprising a first stepped part provided along a border of the supply hole and configured to accommodate at least a portion of the filtering part and a second stepped part that is stepped with respect to the first stepped part, wherein the first flow path is formed by the second stepped part, and, wherein the top surface of the edge of the filtering part and the bottom surface of the housing are configured to contact the fluid sample flowing through the first flow path.

12. The fluid analysis cartridge of claim 11, wherein the first flow path is provided to have a depth of at least 1 μm or a depth that corresponds to less than or equal to 90% of a depth of the supply hole.

13. The fluid analysis cartridge of claim 11, wherein the stepped part is provided in a radial shape with respect to the supply hole.

14. The fluid analysis cartridge of claim 11, further comprising a testing part that is combined with the housing, the testing part comprising a second flow path through which the fluid sample filtered by the filtering part flows.

15. The fluid analysis cartridge of claim 14, wherein the testing part comprises an upper plate and a lower plate having a film shape and an intermediate plate inserted between the upper plate and the lower plate, and the second flow path is formed on the intermediate plate.

16. The fluid analysis cartridge of claim 15, wherein the intermediate plate comprises a plurality of testing chambers configured to test the fluid sample.

17. A fluid testing device, comprising:

a housing comprising an opening through which a fluid is configured to flow into;

a testing portion connected to the housing and configured to test the fluid;

a filter disposed between the opening and the testing portion and configured to filter the fluid, the filter comprising an upper surface through which the fluid initially flows during filtering;

a first flow path that is formed between the upper surface of the filter and a bottom surface of the housing facing an edge portion of the upper surface of the filter, the first flow path being configured to pass the fluid sample before the fluid sample contacts the filter; and a stepped part comprising a first stepped part provided along a border of the opening and configured to accommodate at least a portion of the filter and a second stepped part that is stepped with respect to the first stepped part, wherein the first flow path is formed by the second stepped part, and wherein the entire upper surface of the filter is spaced apart from the housing.

18. The fluid testing device of claim 17, wherein the filter further comprises sides which are connected to the housing, and the fluid testing device comprises the stepped part to space apart portions of the upper surface corresponding to the sides of the filter from the housing.

19. The fluid testing device of claim 17, wherein the stepped part comprises a plurality of protrusions formed in a circular pattern corresponding to a circular pattern of the opening.

* * * * *